US009691574B2

(12) United States Patent
Gerovac et al.

(10) Patent No.: US 9,691,574 B2
(45) Date of Patent: Jun. 27, 2017

(54) MEDIUM OR HIGH VOLTAGE SWITCH BUSHING

(75) Inventors: Joseph P. Gerovac, Menomonee Falls, WI (US); Robert A. Traska, Cedarburg, WI (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/407,389

(22) PCT Filed: Jun. 12, 2012

(86) PCT No.: PCT/US2012/042077

§ 371 (c)(1), (2), (4) Date: Jul. 13, 2015

(87) PCT Pub. No.: WO2013/187886

PCT Pub. Date: Dec. 19, 2013

(65) Prior Publication Data

US 2016/0126037 A1 May 5, 2016

(51) Int. Cl.

| | |
|---|---|
| ***H01H 33/662*** | (2006.01) |
| ***H01H 33/53*** | (2006.01) |
| ***H01H 33/66*** | (2006.01) |
| ***H01H 33/666*** | (2006.01) |

(52) U.S. Cl.

CPC ..... *H01H 33/53* (2013.01); *H01H 33/662* (2013.01); *H01H 33/6606* (2013.01); *H01H 33/666* (2013.01); *H01H 33/66207* (2013.01); *H01H 2223/002* (2013.01)

(58) Field of Classification Search

CPC ..... H01H 2085/025; H01H 2085/209; H01H 85/0039; H01H 85/0241; H01H 85/40; H01H 85/50

See application file for complete search history.

(56) References Cited

U.S. PATENT DOCUMENTS

| | | | | |
|---|---|---|---|---|
| 3,309,477 | A * | 3/1967 | Bronikowski | H01H 85/0241 337/158 |
| 3,567,886 | A | 3/1971 | Ross | |
| 4,124,790 | A * | 11/1978 | Kumbera | H01H 33/666 200/302.1 |
| 4,714,438 | A | 12/1987 | Williams | |
| 5,387,772 | A | 2/1995 | Bestel | |
| 5,597,992 | A | 1/1997 | Walker | |

(Continued)

FOREIGN PATENT DOCUMENTS

| | | |
|---|---|---|
| AU | 706795 B3 | 6/1999 |
| CN | 2132273 Y | 5/1993 |

(Continued)

*Primary Examiner* — Truc Nguyen
(74) *Attorney, Agent, or Firm* — Dickinson Wright PLLC

(57) ABSTRACT

A medium or high voltage switch is provided. The medium or high voltage switch includes a bottle assembly and a bushing. The bottle assembly includes a bottle formed of a first material and defining a chamber. The bottle assembly further includes a plurality of contacts for selectively opening and closing an electrical circuit, the plurality of contacts disposed within the chamber. The bushing is formed of a second material and defines a cavity configured to receive the bottle assembly. The bottle assembly and the bushing have an interference fit.

17 Claims, 10 Drawing Sheets

(56) References Cited

U.S. PATENT DOCUMENTS 5,808,258 A * 9/1998 Luzzi ..... H01H 33/66207 218/136
5,990,440 A 11/1999 Yamaguchi et al.
6,198,062 B1 * 3/2001 Mather ..... H01H 33/022 218/120
6,657,150 B1 12/2003 Shea et al.
6,747,234 B2 * 6/2004 Traska ..... H01H 33/24 218/134
8,110,770 B2 2/2012 Ichikawa et al.
8,785,804 B2 * 7/2014 Gibson ..... H01H 33/025 218/131
2004/0061589 A1 * 4/2004 Daharsh ..... H01C 7/12 338/21
2005/0067380 A1 * 3/2005 Rhein ..... H01H 33/6662 218/118
2006/0011589 A1 * 1/2006 Hering ..... H01H 33/66207 218/118
2006/0266630 A1 * 11/2006 Stepniak ..... H01H 33/02 200/16 D
2007/0108164 A1 * 5/2007 Muench ..... H01H 33/66207 218/118
2007/0295694 A1 * 12/2007 Lindner ..... H01H 33/53 218/156
2009/0200270 A1 * 8/2009 Chen ..... H01H 33/6606 218/119
2010/0170774 A1 * 7/2010 Einschenk ..... H01H 33/027 200/48 R
2010/0314357 A1 * 12/2010 Kobayashi ..... H01H 33/66207 218/140
2011/0204030 A1 8/2011 Mangan et al.
2012/0193325 A1 8/2012 Borgstrom
2013/0126479 A1 * 5/2013 Shang ..... H01H 33/66207 218/120
2013/0126480 A1 * 5/2013 Shang ..... H01H 33/66207 218/134
2016/0126037 A1 * 5/2016 Gerovac ..... H01H 33/6606 218/139

FOREIGN PATENT DOCUMENTS

CN 1156891 A 8/1997
CN 1672228 A 9/2005
CN 101395686 A 3/2009
DE 69307560 T2 5/1997
EP 0209384 A2 1/1987

* cited by examiner

MEDIUM OR HIGH VOLTAGE SWITCH BUSHING

BACKGROUND

The present specification relates generally to the field of medium or high voltage switches. More particularly, the present specification relates to bushings for medium or high voltage switches.

Switches (e.g., capacitor switches, vacuum interrupter based voltage switches, etc.) may be used to connect and disconnect electrical equipment from medium or high voltage lines. Switches typically include a vacuum interrupter inside of a bushing, and the operational and environmental requirements of medium or high voltage switches typically require the use of costly materials such as cycloaliphatic epoxy. An interrupter is typically installed in a bushing in one of two ways: (1) encapsulating the interrupter in a flexible material, such as urethane or silicone, and then encapsulating the flexible material into a cycloaliphatic epoxy, or (2) mechanically installing the interrupter in a cycloaliphatic epoxy bushing and using polyurethane to bond the interrupter to the bushing. These methods require costly materials and make it prohibitively difficult to salvage or repair an interrupter from a damaged bushing.

Therefore, there is a need for an improved medium or high voltage switch. There is also a need for a switch bushing that uses lower cost materials. There is further a need for a switch that permits repair and replacement of the interrupter in the bushing. Yet further, there is a need for a high or medium voltage switch that uses a low cost bushing material and meets environmental requirements of switching applications. There is also a need for a method of manufacturing a high or medium voltage switch using a low cost bushing material.

SUMMARY

One embodiment relates to a medium or high voltage switch including a bottle assembly and a bushing. The bottle assembly includes a bottle formed of a first material and defining a chamber. The bottle assembly further includes a plurality of contacts for selectively opening and closing an electrical circuit, the plurality of contacts disposed within the chamber. The bushing is formed of a second material and defines a cavity configured to receive the bottle assembly. The bottle assembly and the bushing have an interference fit.

Another embodiment relates to a medium or high voltage switch. The medium or high voltage switch includes a first terminal, a bottle assembly, a bushing, and a compression member. The bottle assembly includes a bottle defining a chamber and includes a plurality of contacts for selectively opening and closing an electrical circuit, the plurality of contacts disposed within the chamber. The plurality of contacts includes a first contact electrically coupled to the first terminal. The bushing defines a cavity configured to receive the bottle assembly, and includes a boss having the first terminal extending at least partially therethrough. The compression member compresses the boss against the terminal to form a seal.

Another embodiment relates to a medium or high voltage switch including a bottle assembly and a unitary bushing. The bottle assembly includes a bottle defining a chamber and includes a plurality of contacts for selectively opening and closing an electrical circuit, the plurality of contacts disposed within the chamber. The unitary bushing defines a cavity configured to receive the bottle assembly. The bushing includes a head portion defining the first cavity and includes a tank portion defining a second cavity receiving an operating mechanism interconnected with at least one of the plurality of contacts and configured to selectively couple and decouple the at least one of the plurality of contacts with another of the plurality of contacts.

Another embodiment relates to a method of manufacturing a switch. The method includes providing a bottle assembly including a bottle defining a chamber and a plurality of contacts for selectively opening and closing an electrical circuit, the plurality of contacts disposed within the chamber. The method further includes pressing the bottle assembly into a bushing, the bottle assembly and the bushing having an interference fit therebetween.

Another embodiment relates to a method of manufacturing a switch. The method includes providing a bottle assembly including a bottle defining a chamber and a plurality of contacts for selectively opening and closing an electrical circuit, wherein the plurality of contacts are disposed within the chamber. The method further includes molding a first material (e.g., polyurethane) to the bottle assembly, applying dielectric grease to the first material, and pressing the bottle assembly into a bushing formed of a second material, the bottle assembly and the bushing having an interference fit therebetween.

Another embodiment relates to a method of manufacturing a switch. The method includes providing a bottle assembly including a bottle defining a chamber and a plurality of contacts for selectively opening and closing an electrical circuit, the plurality of contacts disposed within the chamber. The method further includes providing a sleeve, applying dielectric grease to the bottle, and pressing the bottle into the sleeve, the bottle and sleeve having an interference fit therebetween.

Another embodiment relates to a method of assembling a switch. The method includes providing a bushing having a boss disposed thereupon, the bushing defining a cavity having a bottle assembly disposed therein, the bottle assembly including a bottle defining a chamber and a plurality of contacts for selectively opening and closing an electrical circuit, the plurality of contacts disposed within the chamber and comprising a first contact electrically coupled to a first terminal, the first terminal extending at least partially through the boss. The method further includes disposing a compression member around the boss, and compressing the compression member such that the boss forms a seal against the terminal.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a medium or high voltage switch, and components thereof, are shown according to an exemplary embodiment. Medium voltage switches may be used in utility power distribution environments, for example, in a pole-mounted or pad-mounted interrupter, operating in circuits of approximately 1,000 Volts to 38,000 Volts and 200 amps to 400 amps. High voltage switches may be used at voltage levels exceeding approximately 38,000 Volts. The switch (e.g., switchgear, etc.) generally includes an electrically insulating bushing and a conductor passing therethrough. The conductor includes a plurality of selectively separable contacts which allow the circuit of which the conductor is a part to be opened or closed. The switch may include an operating mechanism configured to selectively close (i.e., join) and open (i.e., separate) the pair of contacts.

According to an exemplary embodiment, the switch is a vacuum interrupter based medium voltage capacitor switch. In such an embodiment, the contacts are disposed within an evacuated bottle, and the vacuum inhibits arcing when the contacts are brought in and out of contact with each other. In such embodiments, the bottle is a vacuum interrupter. According to other embodiments, the bottle may be filled with oil, an arc inhibiting gas (e.g., sulfur hexafluoride (SF6)), or otherwise contain an arc-inhibiting medium or mechanism.

Before discussing further details of the switch and/or the components thereof, it should be noted that references to "front," "rear," "top," "bottom," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 1:
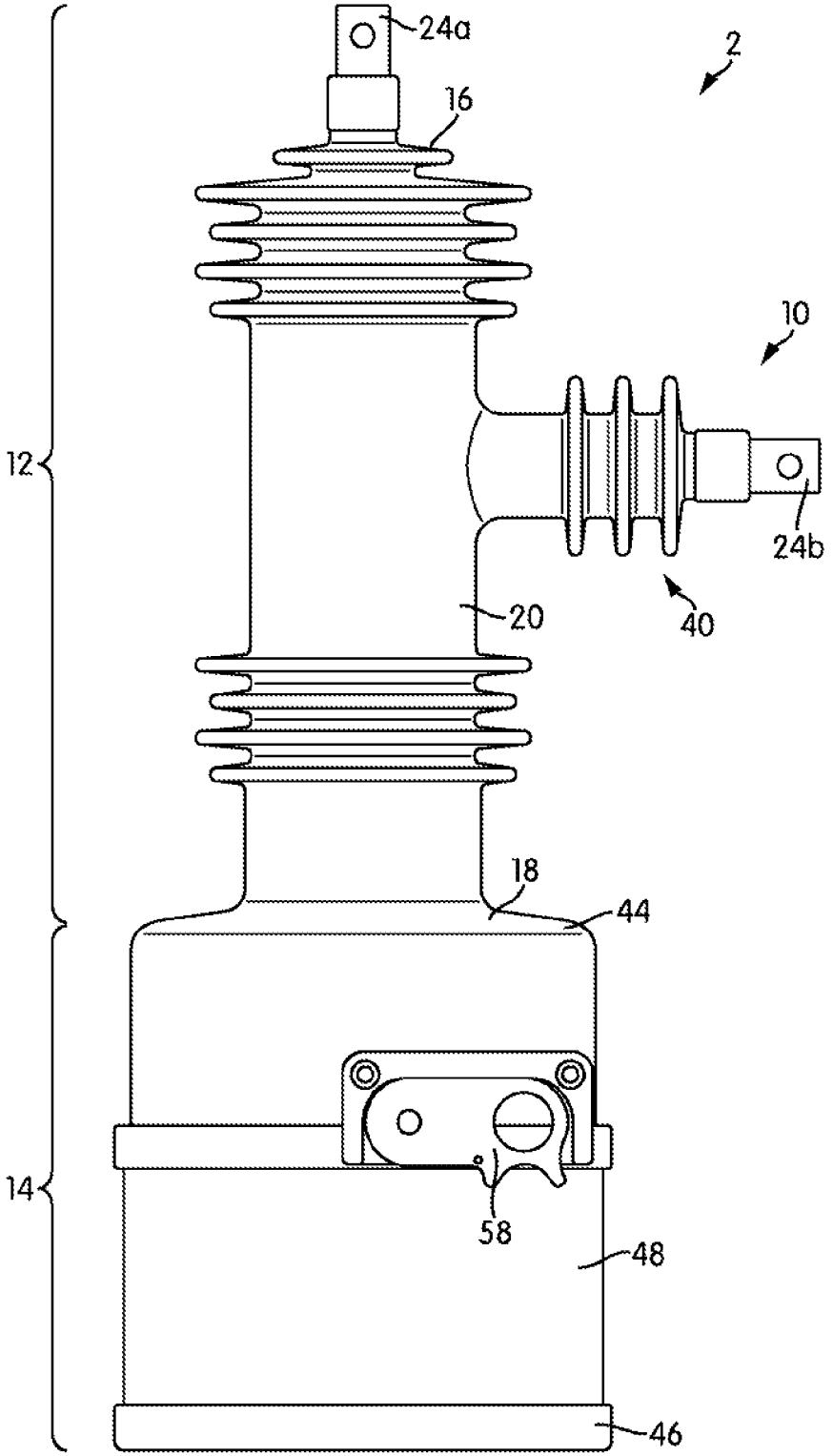
FIG. 1 is a right elevational view schematic drawing of a medium or high voltage switch, shown according to an exemplary embodiment.
Figure 2:
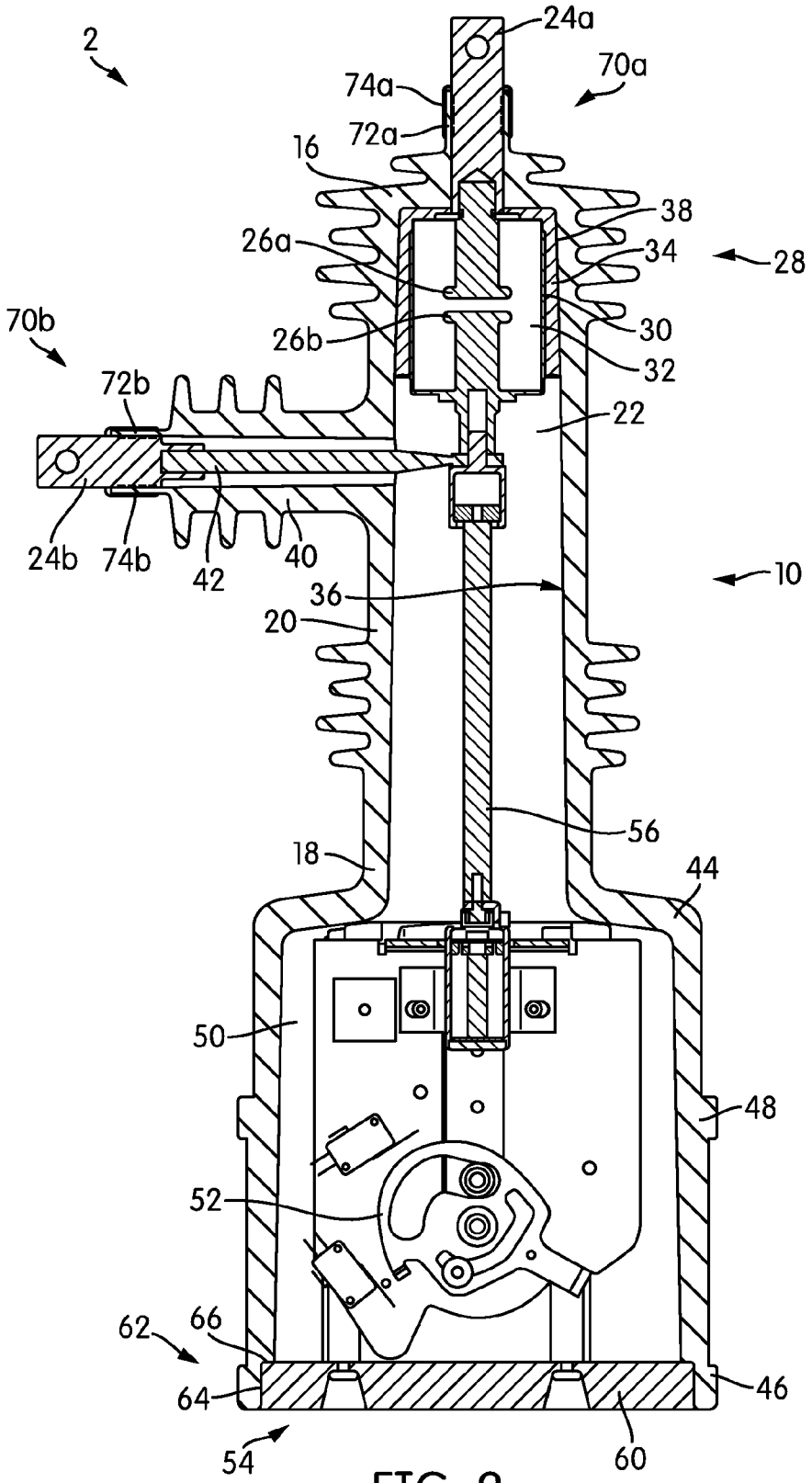
FIG. 2 is a left elevational cross-sectional view schematic drawing of the medium or high voltage switch of FIG. 1, shown according to an exemplary embodiment.

Referring to FIGS. 1 and 2, a medium or high voltage switch 2 is shown according to an exemplary embodiment. The switch 2 includes a housing 10 (e.g., bushing, body, etc.) having a head 12 (e.g., a head portion) and a tank 14 (e.g., tank portion). The head 12 includes a first end, shown as top end 16, and a distal second end, shown as bottom end 18. A sidewall 20 extending therebetween at least partially defines a first cavity 22.

The head 12 supports a plurality of terminals 24, shown as a first terminal 24*a* and a second terminal 24*b*. The first terminal 24*a* is coupled to a first electrical contact 26*a* and may be coupled to a first side (e.g., positive, negative, ground, load, electrical equipment, etc.) of an electrical circuit. The second terminal 24*b* is coupled to a second electrical contact 26*b* and may be coupled to a second side (e.g., negative, positive, ground, load, electrical equipment, etc.) of an electrical circuit. The first and second electrical contacts 26*a*, 26*b* may be selectively coupled and decoupled to close and open the electrical circuit, respectively. The particular orientation and number of contacts 26*a*, 26*b* is not shown in a limiting fashion.

A bottle assembly 28 is supported in the head 12 and includes a bottle 30 (e.g., interrupter, body, etc.) and the first and second contacts 26*a*, 26*b*. The bottle 30 defines a chamber 32 into which the first and second contacts 26*a*, 26*b* extend. According to the exemplary embodiment shown, the gas (e.g., air) has been evacuated or removed from the chamber 32 to substantially form a vacuum. Thus, the creation and propagation of an electrical arc as the first and second contacts 26*a*, 26*b* are brought into and out of contact with one another are inhibited. The bottle 30 may be formed out of any suitable material, for example, porcelain or ceramic, and may be embodied in a variety of forms including various types of contact mechanisms. The bottle 30 is not shown in a limiting fashion.

The head 12 may be formed of any suitable dielectric material, for example, cycloaliphatic epoxy, porcelain, polymer, ceramic, etc. According to the exemplary embodiment shown, the head 12 is formed of high density polyethylene (HDPE). HDPE is approximately twenty percent lighter than cycloaliphatic epoxy, thus significantly reducing the weight of the switch, which is a concern, for example, in pole-mount applications. Placing the bottle 30 in a dielectric material enables use of the bottle assembly 28 for elevated voltages, as well as for outdoor use. The head 12 constitutes at least a portion of a bushing, insulating the bottle 30 and electrical conductors between the first and second terminals 24*a*, 24*b*. The head 12 further protects the bottle 30 and the electrical conductors from the external environment (e.g., precipitation, wind, debris, etc.).

The bottle assembly 28 may further include a sleeve 34 having the bottle 30 disposed therein. The sleeve 34 may be molded (e.g., overmolded, injection molded, poured, etc.) on the bottle 30. According to an exemplary embodiment, the sleeve 34 is formed of polyurethane, which may bond to the bottle 30.

The bottle assembly 28 is disposed within the first cavity 22 of the head 12. According to the exemplary embodiment shown, the bottle assembly 28 is an interference fit (e.g., press fit, force fit, etc.) with the head 12. To facilitate the interference fit, an inner surface 36 of the head 12 may be tapered between the bottom end 18 and the top end 16, from a diameter greater than the diameter of the bottle assembly 28 to a diameter equal to or less than the diameter of the bottle assembly 28. In an embodiment having a sleeve 34, the sleeve 34 may be compressed between the head 12 and the bottle 30. Compressing the sleeve 34 between the head 12 and the bottle 30 enables a better fit and allows the sleeve 34 to absorb the thermal contraction and expansion of the bottle 30 while maintaining contact with both the head 12 and the bottle 30. A dielectric grease 38 (e.g., silicone grease) may be used between the inner surface 36 of the head 12 and the bottle assembly 28. The dielectric grease may be applied as a layer, coating, etc., to an outer surface of the sleeve 34. The dielectric grease 38 fills voids between the bottle assembly and the head 12, thereby maintaining electrical integrity of the opposite polarities of the switch 2.

Providing an interference fit between the head 12 and the bottle assembly 28 provides a low-cost coupling having electrical integrity. Further, HDPE is extremely chemically resistant, and is thus very difficult to chemically bond to unless the surface is prepared, for example, using an ion or electron gun. Providing an interference fit creates a mechanical joint that does not rely on chemical bonding, and is thus particularly useful in the embodiment using a head 12 formed of HDPE.

According to the exemplary embodiment shown, the mechanical joint between the sleeve 34 and the head 12 is reversible with sufficient force. In one embodiment, the bottle assembly 28 may be decoupled (e.g., pulled from, pushed from, etc.) from the head 12 in order to repair or replace the component, thus lowering production costs and facilitating servicing of the switch during production and in the field.

Figure 5:
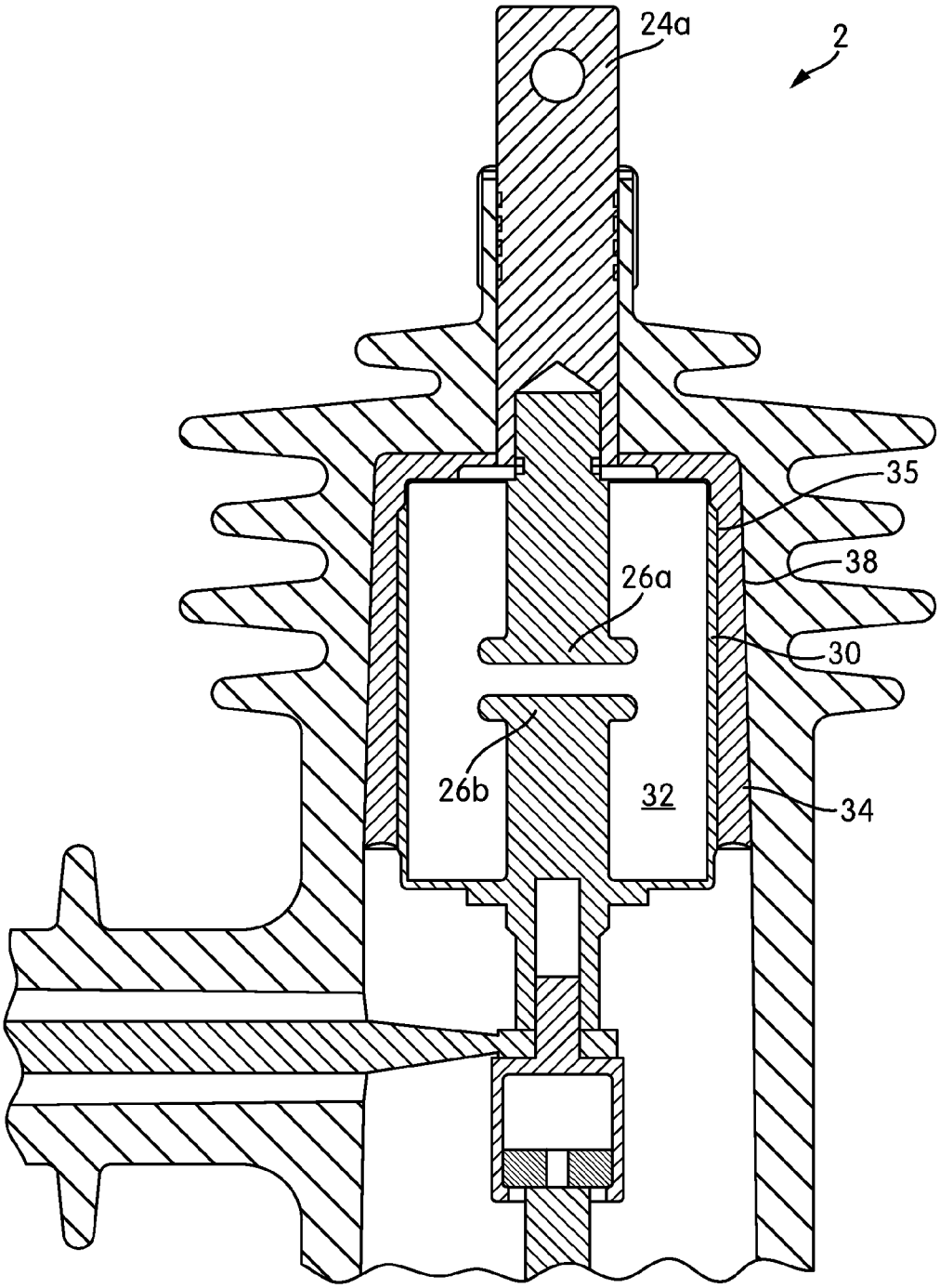
FIG. 5 is an enlarged cross-sectional view schematic drawing of a portion of the medium or high voltage switch, shown according to another embodiment.

Referring to FIG. 5, an enlarged view of a portion of switch 2 is shown, according to another embodiment. The sleeve 34 may be formed separately from the bottle 30. For example, the sleeve 34 may be injection molded. The bottle 30 may then be pressed into the sleeve 34. According to one embodiment, there is an interference fit between the sleeve 34 and the bottle 30. A dielectric grease 35 (e.g., silicone grease) may be used between an outer surface of the bottle 30 and an inner surface of sleeve 34. The dielectric grease 35 fills voids between the bottle 30 and the sleeve 34, thereby maintaining electrical integrity of the opposite polarities of the switch 2.

Figure 6:
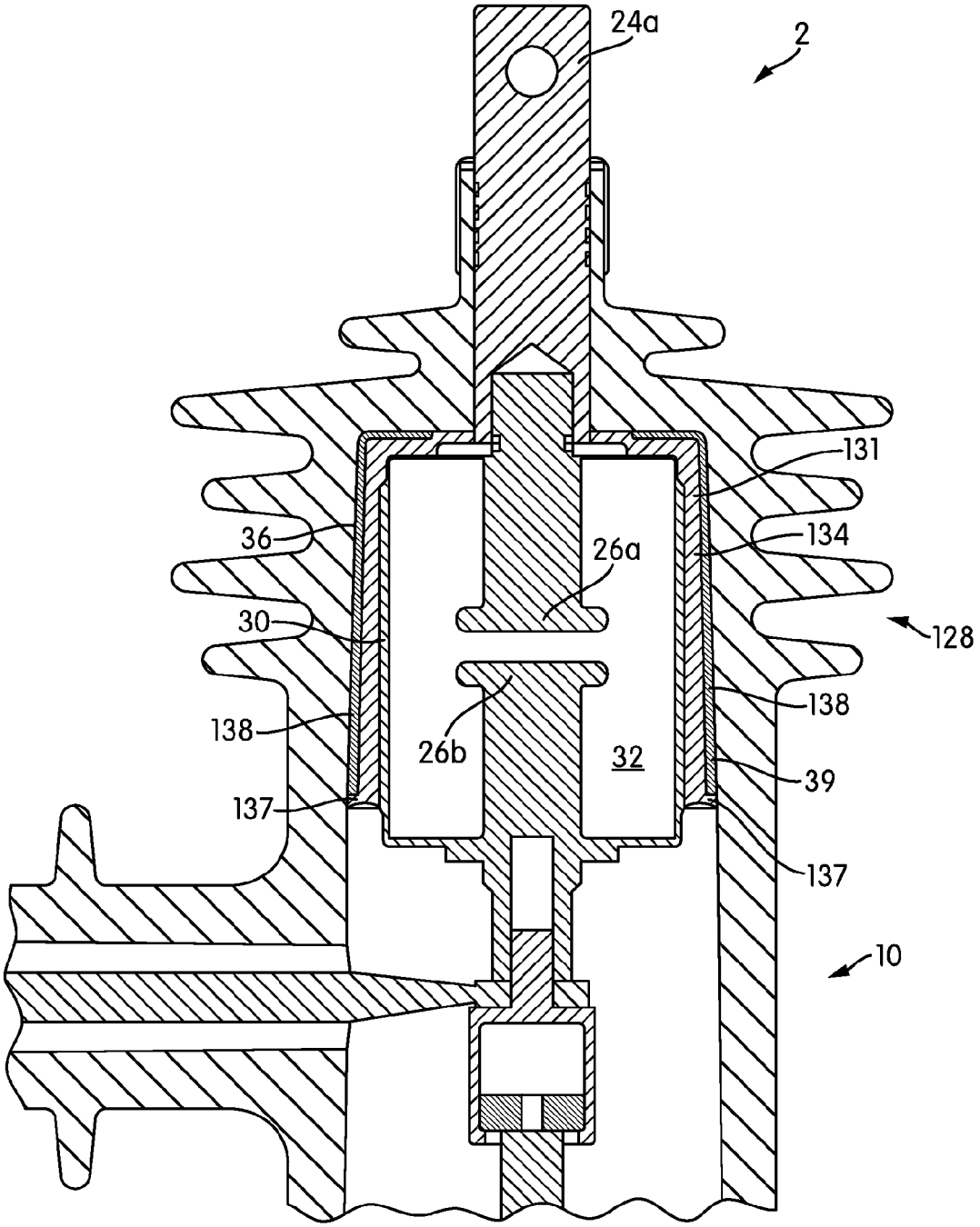
FIG. 6 is an enlarged cross-sectional view schematic drawing of a portion of the medium or high voltage switch, shown according to another embodiment.

Referring to FIG. 6, an enlarged view of a portion of switch 2 is shown, according to another embodiment. A bottle assembly 128 is shown disposed within the first cavity 22 of the housing 10. According to the exemplary embodiment shown, the bottle assembly 128 is a loose fit with the housing 10. To facilitate the loose fit, a diameter of the inner surface 36 of the housing 10 is greater than a diameter of the bottle assembly 128. For example, a diameter of a sidewall 131 of the sleeve 134 is less than the diameter of the inner surface 36, thereby forming a gap 39 (e.g., chamber, cavity, receptacle, etc.). A substantially continuous media of dielectric grease 138 (e.g., layer, coating, pool, barrier, etc.) is disposed between the sleeve 134 and the housing 10. The dielectric grease 138 fills the gap 39 between the sleeve 134 and the housing 10, thereby maintaining electrical integrity of the opposite polarities of the switch 2. The dielectric grease 138 may be disposed in the gap 39 after the bottle assembly 128 is placed in the housing 10, for example, using an injection process; before the bottle assembly 128 is placed in the housing 10, for example, pouring the dielectric grease into the housing 10 and allowing grease to flow along the sidewall 131 as the bottle assembly 128 displaces the grease in the housing 10; or some combination thereof. According to one embodiment the gap 39 may be evacuated before the dielectric grease is injected into the gap.

The sleeve 134 is shown to include a flange 137 (e.g., flange, ledge, lip, etc.) extending outwardly from a bottom portion (e.g., bottom end, etc.) of the sleeve 134 or sidewall 131 thereof, the flange 137 configured to contact the inner surface 36 of the housing 10 and seal the dielectric grease 138 in the gap 39. According to another embodiment, a discreet sealing member (e.g., an o-ring, etc.) may be disposed between the sleeve 134 and the housing 10. According to various embodiments, one or both of the sleeve 134 and the housing 10 may include a groove configured to receive or seat the sealing member.

Figure 7:
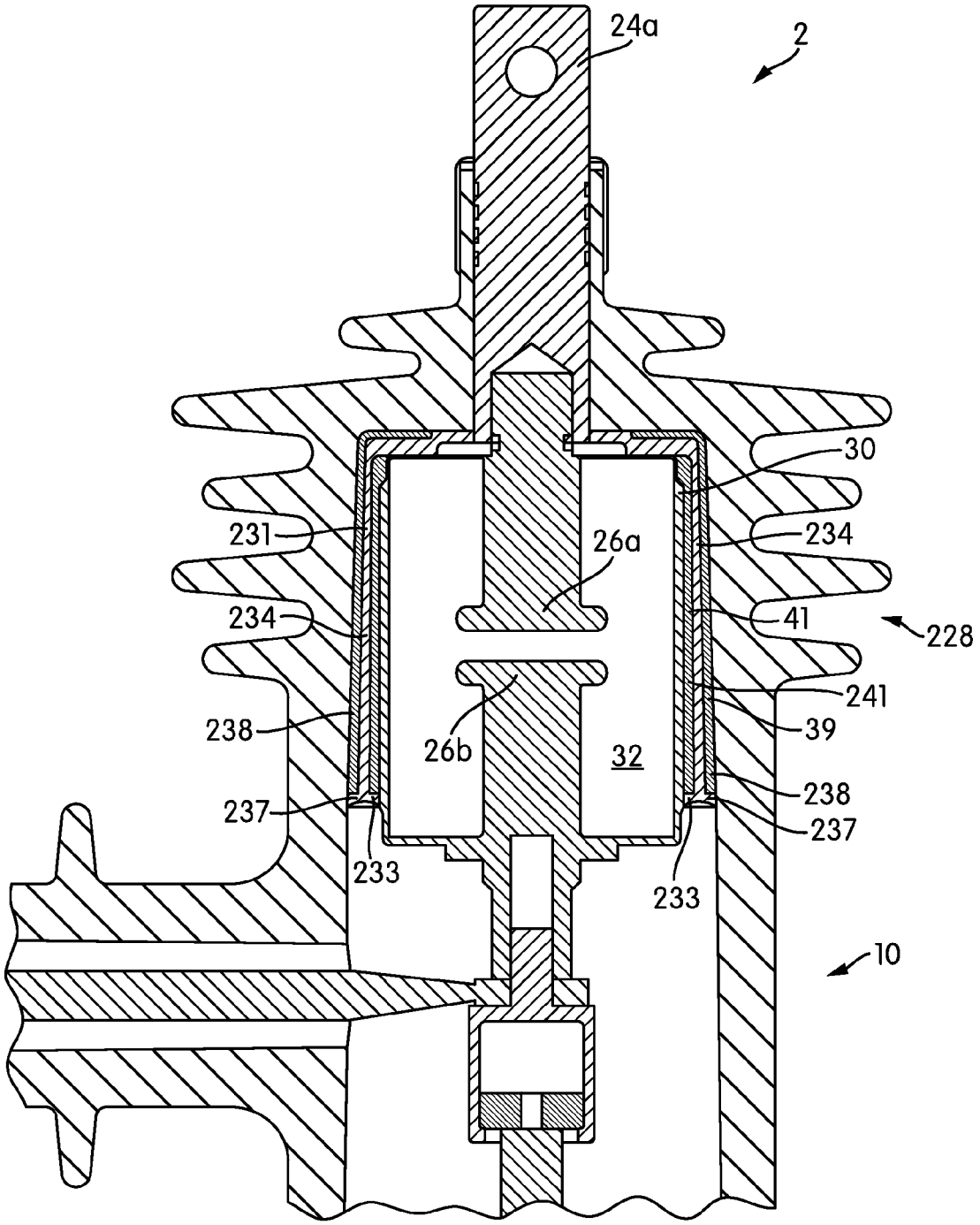
FIG. 7 is an enlarged cross-sectional view schematic drawing of a portion of the medium or high voltage switch, shown according to yet another embodiment.

Referring to FIG. 7, an enlarged view of a portion of switch 2 is shown, according to yet another embodiment. A bottle assembly 228 is shown disposed within the first cavity 22 of the housing 10. According to the embodiment shown, the sleeve 234 may be at least partially spaced apart from the bottle 30, thereby defining a gap 41 (e.g., chamber, cavity, receptacle, etc.). A substantially continuous media of dielectric grease 241 (e.g., layer, coating, pool, barrier, etc.) is disposed between the sleeve 234 and the bottle 30. The dielectric grease 138 fills the gap 41 between the sleeve 234 and the bottle 30, thereby maintaining electrical integrity of the opposite polarities of the switch 2. The dielectric grease 241 may be placed in the gap 41 after the sleeve 234 is placed or formed around the bottle 30, for example, using an injection process; before the bottle 30 is placed in the sleeve 234, for example, pouring the dielectric grease into the sleeve and allowing grease to flow along the sidewall 231 as the bottle 30 displaces the grease in the sleeve 234; or some combination thereof. According to one embodiment the gap 41 may be evacuated before the dielectric grease is injected into the gap. The sleeve 234 is shown to define a gap 39 similar to the gap 39 described with respect to FIG. 6. According to another embodiment, the outer portion of the sidewall 231 may be formed to have an interference fit between the sleeve and the housing 10 as shown and described with respect to FIG. 2.

The sleeve 134 is shown to include a flange 233 (e.g., flange, ledge, lip, etc.) extending inwardly from a bottom portion (e.g., bottom end, etc.) of the sleeve 234 or sidewall 231 thereof, the flange 233 configured to contact an outer surface of the bottle 30 and seal the dielectric grease 241 in the gap 41. According to another embodiment, a discreet sealing member (e.g., an o-ring, etc.) may be disposed between the sleeve 234 and the bottle 30. According to various embodiments, one or both of the sleeve 234 and the bottle 30 may include a groove configured to receive or seat the sealing member.

Returning to FIGS. 1 and 2, the head 12 is further shown to include an arm 40 supporting the second terminal **24*b* and extending laterally from the sidewall 20. The sidewall 20 is shown to extend vertically, and the arm 40 is shown to extend perpendicularly therefrom; however, it is contemplated that the sidewall 20 and the arm 40 may be placed in other orientations or at other angles relative to each other. A cable 42 (e.g., terminal cable) extending through the arm 40 at least partially interconnects the second terminal 24*b* and the second contact 26*b***.

The tank 14 includes a first end, shown as top end 44, and a second end, shown as bottom end 46, and sidewall 48 extending therebetween. As shown, the top end 44 is proximate the head 12, and the bottom end 46 is distal therefrom. The tank 14 defines a second cavity 50 configured to receive an operating mechanism 52 (e.g., closing mechanism, opening mechanism, etc.) and defines an opening 54 for the passage of the operating mechanism 52 therethrough, for example, during assembly or repair of the switch 2.

As shown, the operating mechanism 52 is interconnected with the second contact 26*b* via an operating rod 56. The operating mechanism 52 actuates the operating rod 56 to selectively couple and decouple the second contact 26*b* from the first contact 26*a*. Operating mechanism 52 may be remotely operated, for example using solenoids, or manually operated, for example using a handle 58.

According to one embodiment, the tank 14 may be formed separately from the head 12 and subsequently coupled thereto. According to another embodiment, the head 12 and the tank 14 are portions of a unitary bushing or housing 10. According to various embodiments, the unitary housing 10 may be formed as a single, injection molded or blow-molded HDPE component. Forming the head 12 and the tank 14 as a unitary housing 10 reduces production costs. For example, in highly corrosion resistant applications, the cost of the stainless steel used for the tank could approach half of the material cost of the switch. Also, forming the head 12 and the tank 14 as a unitary housing 10 eliminates a joint between the head 12 and the tank 14 that would otherwise require sealing against leakage.

According to the embodiment shown, the opening 54 is defined by the bottom end 46 of the tank 14. According to another embodiment, the opening 54 passes through the sidewall 48. Forming the opening 54 in the bottom end 46 of the tank 14 discourages precipitation or debris from entering the cavity 50. That is, forming the opening 54 in the bottom end 46 of the tank 14 would require precipitation or debris to travel upwards to enter the housing 10.

A cover 60 may close or seal the opening 54. For example, the cover 60 may form an airtight seal with the tank 14. Forming an airtight seal may inhibit humid or corrosive air (e.g., salt spray) from entering the switch and reacting with the components thereof. According to the embodiment shown, the cover is received in the opening 54, against a seating surface 62, wherein the seating surface 62 includes an inner surface 64 of the tank 14 and a ledge 66 formed therein. According to various embodiments, the cover 60 may seal against one or both of the inner surface 64 and the ledge 66. The cover 60 may be coupled to the tank 14 by any suitable manner, for example, by press fit, snap fit, threaded, adhesive, or, as shown, fasteners 68. According to other embodiments, the cover 60 may couple to a bottom or outer surface of the tank 14, or may include a sealing member (e.g., gasket, o-ring, etc.).

According to other embodiments, the bottom end 46 of the housing 10 may be formed to coupled to a baseplate (not shown). In such an embodiment, the switch 2 may not include a cover 60, or the baseplate may comprise a cover. According to one embodiment, more than one (e.g., two, three, etc.) switches 2 may be coupled to the base plate. For example, the housings 10 of each of three switches 2 may be coupled to a single, flat baseplate. One or more spacers maybe disposed between the housings 10 and the baseplate.

Figure 3:
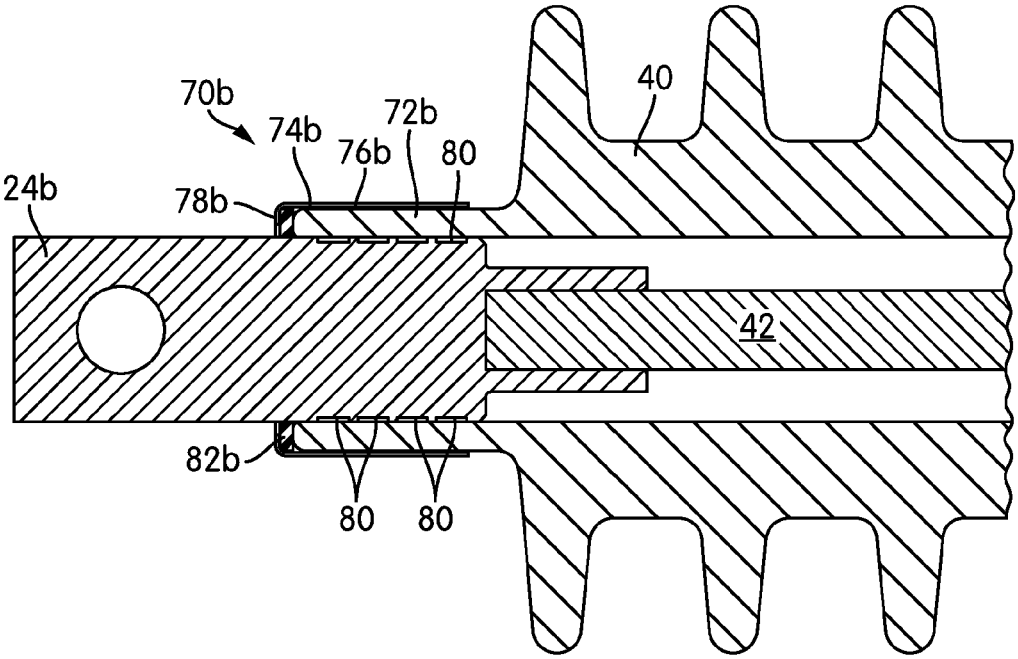
FIG. 3 is an enlarged cross-sectional view schematic drawing of a portion of the medium or high voltage switch of FIG. 1, shown in an uncompressed state, according to an exemplary embodiment.
Figure 4:
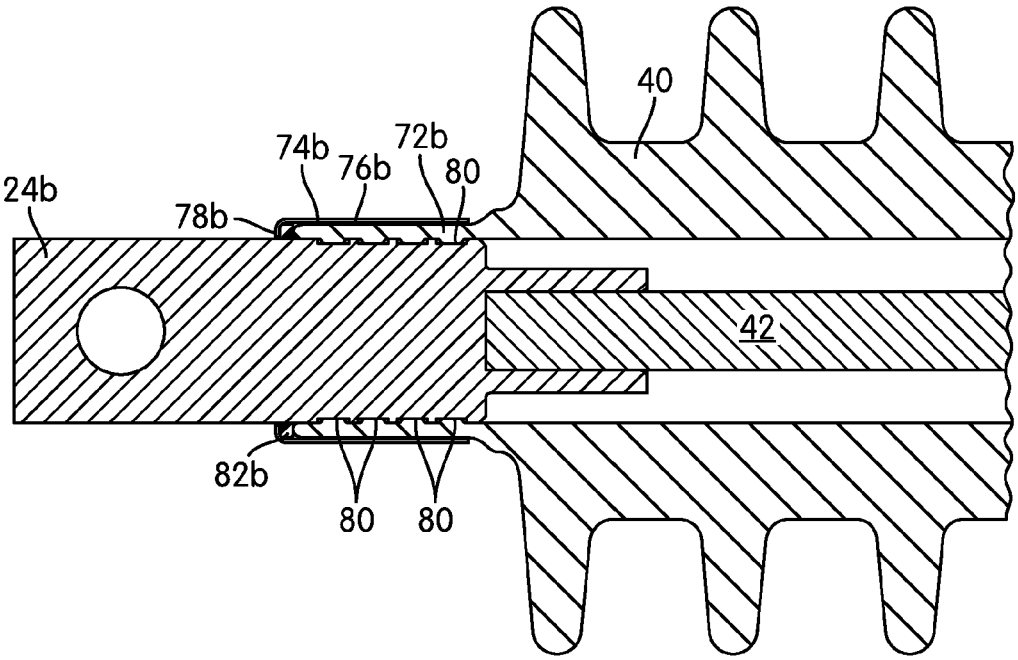
FIG. 4 is an enlarged cross-sectional view schematic drawing of a portion of the medium or high voltage switch of FIG. 1, shown in a compressed state, according to an exemplary embodiment.

Referring to the exemplary embodiment shown in FIGS. 2-4, the head 12 includes a first compression assembly 70*a*, shown proximate the top end 16 of the head 12, and a second compression assembly 70*b*, shown proximate a distal end of the arm 40. The first compression assembly 70*a* includes a boss 72*a* having the first terminal 24*a* extending therethrough and a compression member, shown as ring 74*a*.

Referring now to FIGS. 3 and 4, an enlarged portion of the switch 2 including the second compression assembly 70*b* is shown in an uncompressed state and compressed state, respectively, according to an exemplary embodiment. The description and components of the second compression assembly 70*b* provided herein are generally applicable to the first compression assembly 70*a*. The second terminal 24*b* extends at least partially through a second boss 72*b*, and a compression member, shown as ring 74*b*, compresses the second boss 72*b* against the second terminal 24*b* to form a seal. According to an exemplary embodiment, the ring 74*b* is crimped, for example using a crimping tool, to compress the ring 74*b* and, therefore, the boss 72*b* against the terminal 24*b*.

According to the embodiment shown, the ring 74*b* has a sidewall 76*b* and an inwardly extending flange 78*b*. The flange 78*b* may contact the terminal 24*b* when the ring 74*b* is compressed, thereby keeping the ring 74*b* at the same electrical potential as the terminal 24*b*. In other embodiments, a conductor (e.g., a wire, a disc, a gasket, a washer, etc.) may extend between the terminal 24*b* and the ring 74*b* to equalize the electrical potential.

The terminal 24*b* may include at least one groove 80 configured to receive a portion of the boss 72*b* when the boss 72*b* is compressed against the terminal 24*b*. When the boss 72*b* is compressed into the groove 80 of the terminal 24*b*, the terminal 24*b* is mechanically coupled to the head 12. Accordingly, compressing the boss 72*b* against the terminal 24*b* at least partially retains the bottle assembly 28 in the housing 10. Further, the coupling of the boss 72*b* in the grooves 80 may form a substantially airtight seal between the head 12 and the terminal 24*b*. Forming an airtight seal may inhibit humid or corrosive air (e.g., salt spray) from entering the switch and reacting with the components thereof.

A gasket 82*b* may be disposed between the ring 74*b*, the boss 72*b*, and the terminal 24*b*. Depending on the material selection for the gasket 82*b*, the gasket may form a substantially water and/or airtight seal between the terminal 24*b* and the head 12 and/or may electrically couple the terminal 24*b* and the ring 74*b*.

According to various embodiments, a compression member may be formed as a spring to provide the compressive force around the boss 72*b* instead or in conjunction with the ring 74*b*. The compression member may include a screw and a pattern in the ring such that rotating the screw causes the ring to tighten, or the compression member may be substantially C-shaped and a screw draws the opposite ends of the member together.

According to other embodiments, one or more fasteners (e.g., rivets, screws, pins, etc.) may extend through the boss 72*b* and the terminal 24*b* to retain or support the terminal 24*b* relative to the housing 10. Accordingly, the fastener may retain or support the bottle assembly 28 within the head 12. According to other embodiments, the fastener may also extend through a retention member. Referring briefly to FIG. 3, according to one embodiment, the retention member may have a sidewall and an inwardly extending flange similar to the sidewall 76*b* and flange 78*b* of the embodiment of the ring 74*b* shown. The retention member may or may not be compressed. In an embodiment where the retention member is not compressed, the inwardly extending flange of the retention member may extend further inward than is shown in FIG. 3 to contact the terminal 24*b*. In an embodiment where the retention member is compressed, the retention member may be a compression member. According to other embodiments, a wire, gasket, or other conductor may be used to equalize the potential between the terminal 24*b* and the retention member. The retention member may be loose or press fit onto the boss 72*b*.

Figure 8:
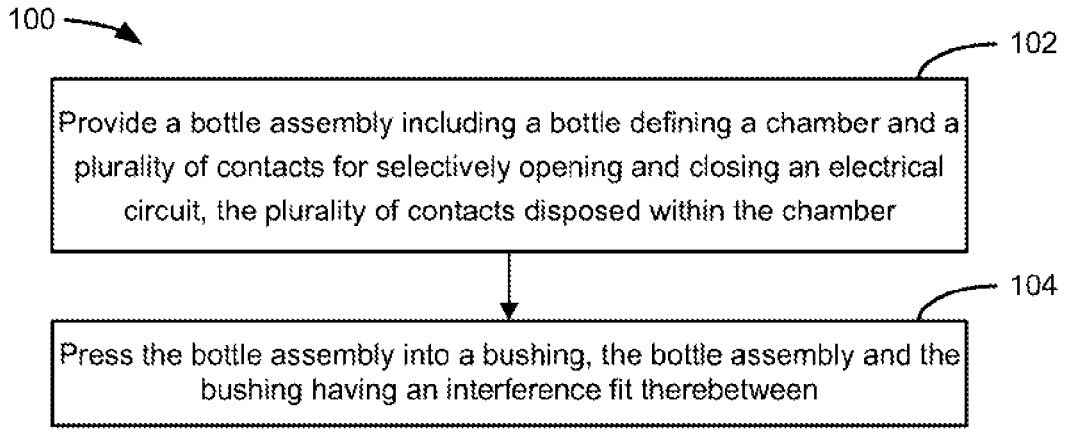
FIG. 8 is a flowchart of a process for manufacturing a switch, according to an exemplary embodiment.
Figure 9:
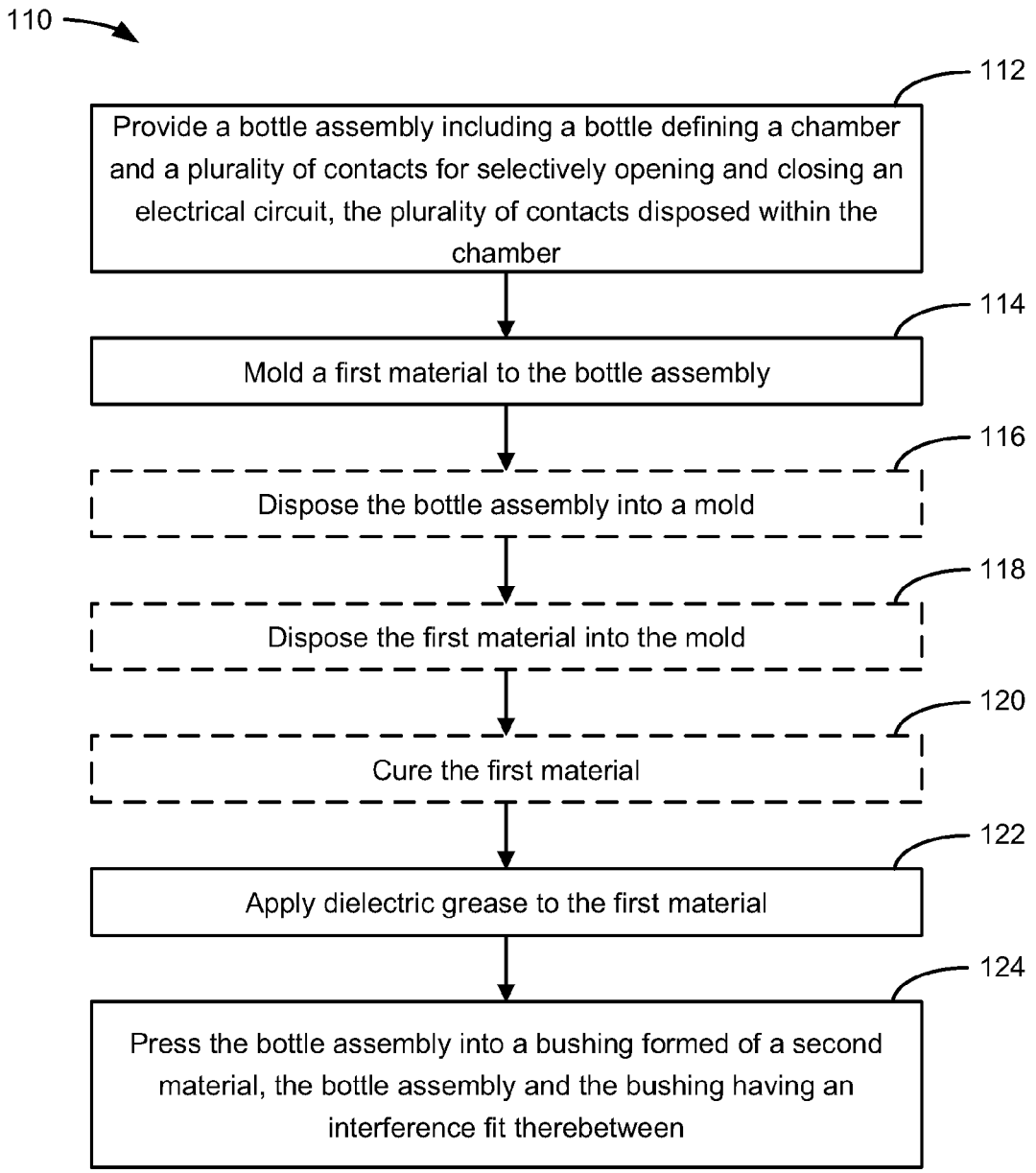
FIG. 9 is a flowchart of a process for manufacturing a switch, according to another embodiment.
Figure 10:
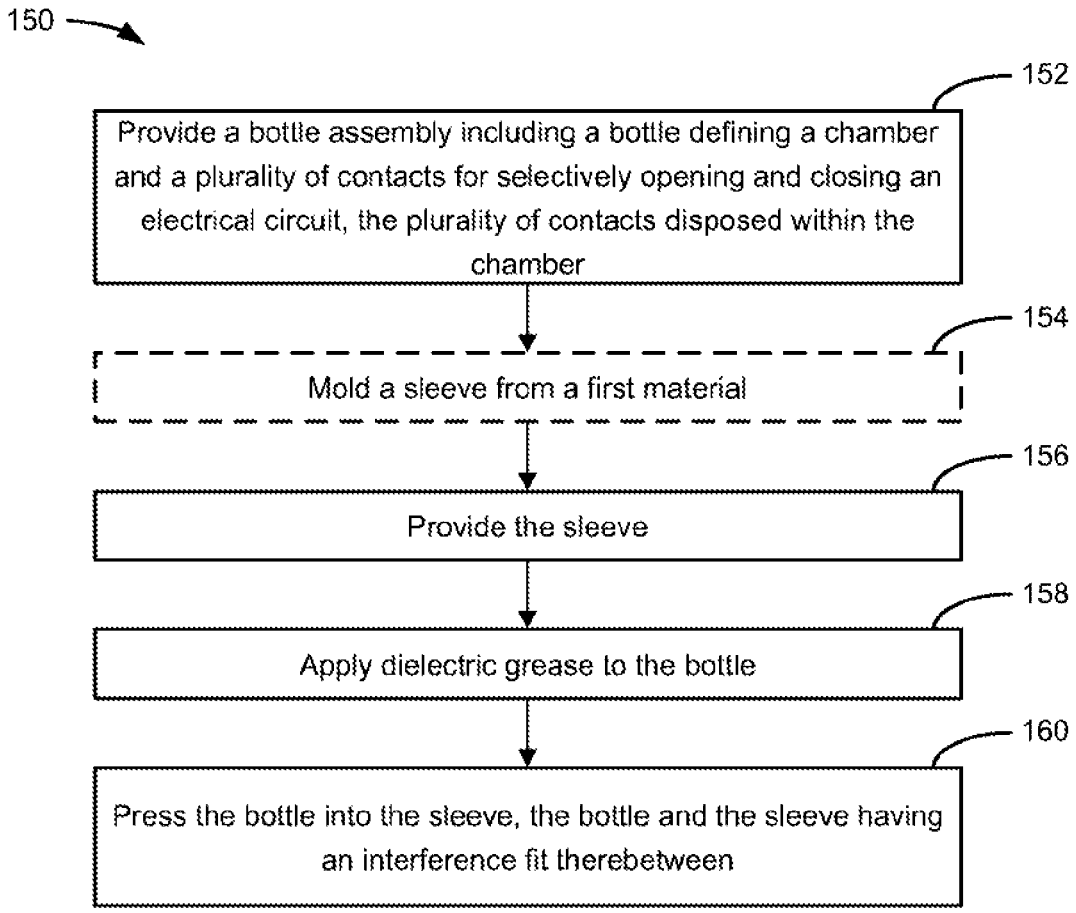
FIG. 10 is a flowchart of a process for manufacturing a switch, according to another embodiment.

Referring to FIGS. 8-10, methods of manufacturing and assembling a switch 2 are shown and described, according to exemplary embodiments.

Referring to FIG. 8, a flowchart of a process 100 for manufacturing a switch is shown according to an exemplary embodiment. Process 100 is shown to include the steps of providing a bottle assembly including a bottle defining a chamber and a plurality of contacts for selectively opening and closing an electrical circuit, the plurality of contacts disposed within the chamber (step 102), and pressing the bottle assembly into a bushing, the bottle assembly and the bushing having an interference fit therebetween (step 104).

Referring to FIG. 9, a flowchart of a process 110 for manufacturing a switch is shown according to another embodiment. Process 110 is shown to include the steps of providing a bottle assembly including a bottle defining a chamber and a plurality of contacts for selectively opening and closing an electrical circuit, the plurality of contacts disposed within the chamber (step 112), molding a first material (e.g., polyurethane) to the bottle assembly (step 114), applying dielectric grease to the first material (step 122), and pressing the bottle assembly into a bushing formed of a second material (e.g., high-density polyethylene), the bottle assembly and the bushing having an interference fit therebetween (step 124). According to one embodiment, the step of molding a first material (step 114) may include the steps of disposing the bottle assembly into a mold (step 116), disposing the first material into the mold (step 118), and curing the first material (step 120).

Referring to FIG. 10, a flowchart of a process 150 for manufacturing a switch is shown according to another embodiment. Process 150 is shown to include the steps of providing a bottle assembly including a bottle defining a chamber and a plurality of contacts for selectively opening and closing an electrical circuit, the plurality of contacts disposed within the chamber (step 152), providing a sleeve (step 156), applying dielectric grease to the bottle (step 158), and pressing the bottle into the sleeve, the bottle and sleeve having an interference fit therebetween (step 160). According to one embodiment, the process 150 may include the step of molding the sleeve from a first material (e.g., polyurethane) (step 154).

Figure 11:
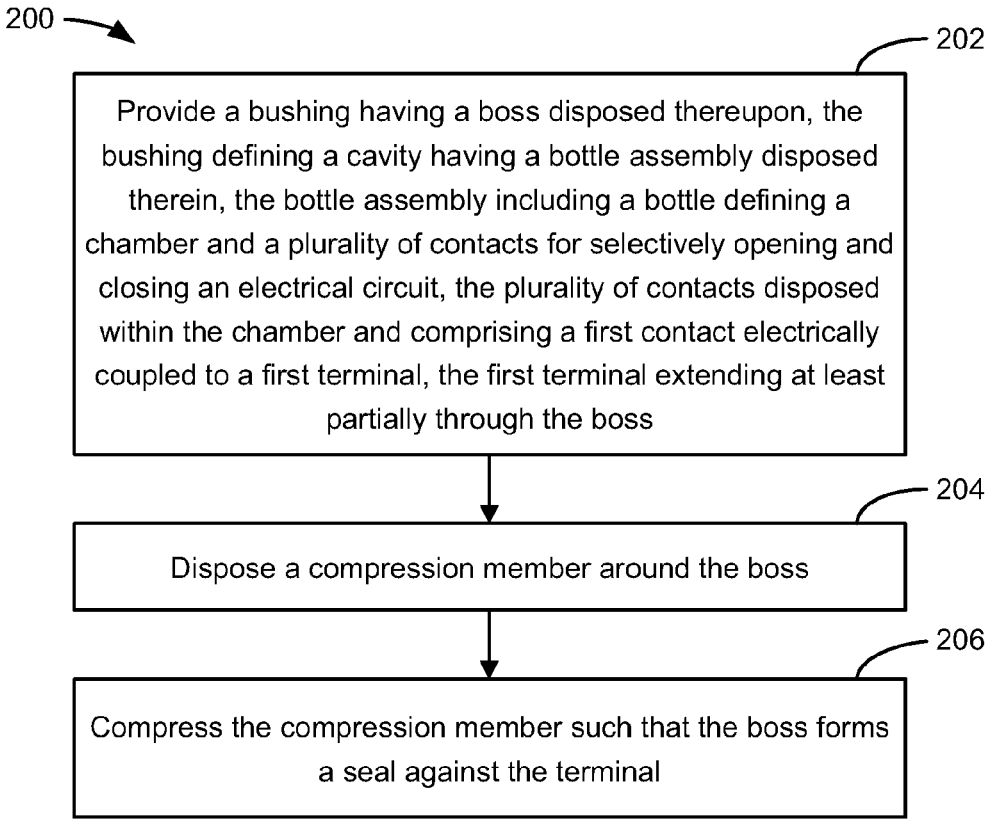
FIG. 11 is a flowchart of a process for assembling a switch, according to yet another exemplary embodiment.

Referring to FIG. 11, a flowchart of a process 200 for assembling a switch is shown according to another exemplary embodiment. Process 200 is shown to include the steps of providing a bushing having a boss disposed thereupon, the bushing defining a cavity having a bottle assembly disposed therein, the bottle assembly including a bottle defining a chamber and a plurality of contacts for selectively opening and closing an electrical circuit, the plurality of contacts disposed within the chamber and comprising a first contact electrically coupled to a first terminal, the first terminal extending at least partially through the boss (step 202), disposing a compression member around the boss (step 204), and compressing (e.g., tightening, crimping, etc.) the compression member such that the boss forms a seal against the terminal (step 206). According to various embodiments, the seal may be a liquid or airtight seal. According to other embodiments, the compressing the compression member compresses the boss against the terminal at least partly retains the bottle assembly in the housing.

The construction and arrangement of the elements of the switch as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A medium or high voltage switch, comprising:
a first terminal;
a bottle assembly comprising:
a bottle defining a chamber;
a plurality of contacts for selectively opening and closing an electrical circuit, the plurality of contacts disposed within the chamber, the plurality of contacts comprising a first contact electrically coupled to the first terminal;
a bushing defining a cavity configured to receive the bottle assembly, the bushing comprising a boss having the first terminal extending at least partially therethrough; and
a compression member compressing the boss against the first terminal to form a seal, the compression member comprising:
a sidewall coupled to the boss; and
an inwardly extending flange coupled to the first terminal.

2. The switch of claim 1, wherein the bottle assembly comprises a sleeve formed of a third material and overmolded onto the bottle.

3. The switch of claim 2 further comprising a dielectric grease disposed between the bottle assembly and the bushing.

4. The switch of claim 1, wherein the third material comprises polyurethane.

5. The switch of claim 1, wherein the second material comprises high-density polyethylene.

6. The switch of claim 1, wherein the chamber is substantially evacuated.

7. The switch of claim 1, wherein the bushing comprises:

a head portion defining the first cavity; and a tank portion defining a second cavity receiving a closing mechanism interconnected with at least one of the plurality of contacts and configured to selectively couple and decouple the at least one of the plurality of contacts with another of the plurality of contacts.

8. The switch of claim 1, wherein the compression member comprises a ring electrically coupled to the terminal.

9. The switch of claim 8, wherein the ring comprises the sidewall coupled to the boss and the inwardly extending flange electrically coupled to the terminal.

10. The switch of claim 1, wherein the compression member compressing the boss against the terminal at least partially retains the bottle within the bushing.

11. The switch of claim 1, wherein the compression member compressing the boss against the terminal forms a substantially airtight seal.

12. The switch of claim 1, wherein the compression member is crimped to the boss.

13. The switch of claim 1 wherein, the bushing is a unitary bushing defining the cavity configured to receive the bottle assembly, the bushing comprising:

a head portion defining the first cavity; and a tank portion defining a second cavity receiving an operating mechanism interconnected with at least one of the plurality of contacts and configured to selectively couple and decouple the at least one of the plurality of contacts with another of the plurality of contacts.

14. The switch of claim 13, wherein the tank portion defines a first opening for the passage of the operating mechanism therethrough, the first opening defined by an end of the tank portion distal the head portion.

15. The switch of claim 13, wherein the tank portion defines a first opening for the passage of the opera ting mechanism therethrough; and further comprising a cover configured to seal the first opening.

16. The switch of claim 15, wherein the tank portion defines an inner seating surface configured to receive the cover.

17. The switch of claim 13, wherein the bushing is formed of high-density polyethylene.

* * * * *